US009911386B2

(12) United States Patent
Winer

(10) Patent No.: US 9,911,386 B2
(45) Date of Patent: Mar. 6, 2018

(54) EFFICIENT LUMINOUS DISPLAY

(75) Inventor: Paul Winer, Santa Clara, CA (US)

(73) Assignee: Intel Corporation, Santa Clara, CA (US)

( * ) Notice: Subject to any disclaimer, the term of this patent is extended or adjusted under 35 U.S.C. 154(b) by 1083 days.

(21) Appl. No.: 12/655,225

(22) Filed: Dec. 24, 2009

(65) Prior Publication Data

US 2011/0157151 A1 Jun. 30, 2011

(51) Int. Cl.

| | |
|---|---|
| ***G09G 3/36*** | (2006.01) |
| ***G09G 3/34*** | (2006.01) |
| *G09G 3/00* | (2006.01) |

(52) U.S. Cl.

CPC ..... *G09G 3/3406* (2013.01); *G09G 3/003* (2013.01); *G09G 2310/08* (2013.01); *G09G 2320/0261* (2013.01); *G09G 2320/064* (2013.01); *G09G 2330/021* (2013.01)

(58) Field of Classification Search

CPC ..... G06F 1/32; G06F 3/01; H04N 13/0055; G02B 27/22

USPC ..... 345/7, 8, 419; 348/47

See application file for complete search history.

(56) References Cited

U.S. PATENT DOCUMENTS

| | | | | |
|---|---|---|---|---|
| 5,821,989 | A * | 10/1998 | Lazzaro et al. | 348/56 |
| 6,115,177 | A * | 9/2000 | Vossler | 359/465 |
| 6,717,556 | B2 * | 4/2004 | Asahi et al. | 345/1.1 |
| 6,885,568 | B2 * | 4/2005 | Kernahan et al. | 363/97 |
| 2002/0075249 | A1 | 6/2002 | Kubota et al. | |
| 2004/0113906 | A1 * | 6/2004 | Lew et al. | 345/211 |
| 2006/0055654 | A1 | 3/2006 | Sagawa et al. | |
| 2008/0079804 | A1 | 4/2008 | Hamagishi et al. | |
| 2011/0141244 | A1 * | 6/2011 | Vos et al. | 348/51 |

FOREIGN PATENT DOCUMENTS

| | | | |
|---|---|---|---|
| CN | 101131810 | A | 2/2008 |
| CN | 101345038 | A | 1/2009 |
| JP | 2000-043740 | A | 2/2000 |
| JP | 2008-109607 | A | 5/2008 |
| TW | 200634687 | A | 10/2006 |

OTHER PUBLICATIONS

Office Action Received for Korean Patent Application No. 2010-0133312, dated Jun. 25, 2012, 1 page of English Translation only.

Notice of Allowance Received for Korean Patent Application No. 2010-0133312, dated Oct. 22, 2012, 2 pages of Notice of Allowance and 1 page of English Translation.

(Continued)

*Primary Examiner* — Calvin C Ma

(74) *Attorney, Agent, or Firm* — Alpine Technology Law Group LLC

(57) ABSTRACT

In one embodiment a display assembly comprises a liquid crystal module, a backlight assembly comprising an array of light emitting diodes, a timing controller, and a backlight controller coupled to the timing controller. The backlight controller comprises logic to initiate a power activation cycle at the beginning of an image presentation timing cycle and terminate the power activation cycle at the termination of the image presentation timing cycle. Other embodiments may be described.

15 Claims, 5 Drawing Sheets

(56) References Cited

OTHER PUBLICATIONS

Office Action Received for Chinese Patent Application No. 201010621007.7, dated Oct. 17, 2012, 5 pages of Office Action and 7 pages of English Translation.
Office Action received for Chinese Patent Application No. 201010621007.7, dated Jul. 31, 2013, 6 pages of English Translation and 3 pages of Office Action.
Official Letter and Search Report received for Taiwanese Patent Application No. 99142780, dated Jun. 17, 2015, 3 pages.

* cited by examiner

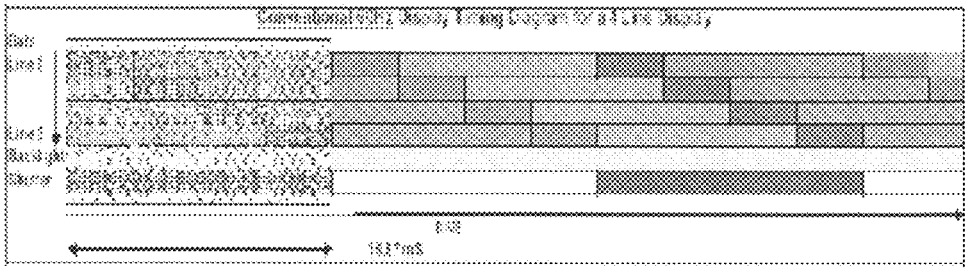
FIG. 4A
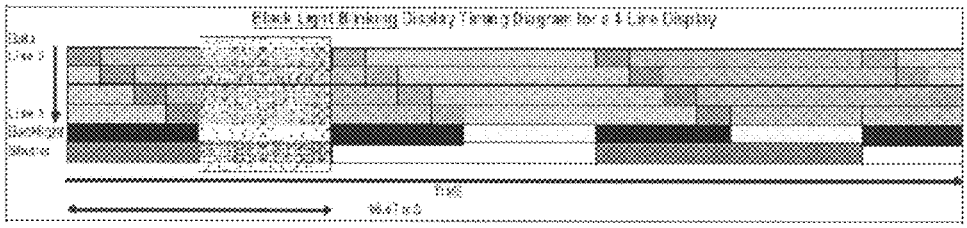
FIG. 4B
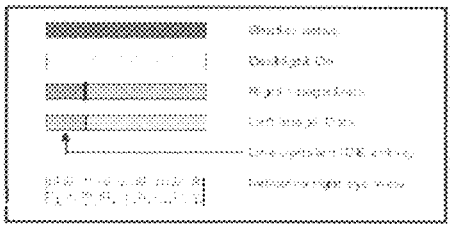

EFFICIENT LUMINOUS DISPLAY

RELATED APPLICATIONS

None.

BACKGROUND

The subject matter described herein relates generally to the field of displays and more particularly to an efficient luminous display which may be used in electronic devices.

In some instances motion blur in an LCD display is due to the "sample and hold" nature of operation of the display. This interacts with a smooth pursuit of moving objects by the human visual system resulting in blurred images. One approach to resolve this is to increase the frame rate of the display by a factor of two and alternate black frames with the image frames. This produces a display with an impulse response, but results in a fifty percent loss of luminous efficiency. Thus, the backlight power must be doubled to return the display to full luminance.

One approach to providing stereoscopic three-dimensional images is through the use of shutter glasses to demultiplex a series of left eye and right eye images shown in a rapid alternating sequence. Under typical LCD display timing it is not viable to fully separate the left eye and right eye images with an LCD display. In order to provide the correct image to each eye the period of time when the display is not updated, commonly referred to as the VBlank period, must be extended and the period of time when the display is updated must be reduced. A high performance display system may have the VBlank period extended to 33% of the available frame time and the shutter glasses synchronized to open during VBlank. In this condition the total luminance efficiency is reduced to 33% relative to the available frame time.

Accordingly techniques to implement an efficient luminous display may find utility.

BRIEF DESCRIPTION OF THE DRAWINGS

The detailed description is described with reference to the accompanying figures.

FIGS. 4A and 4B are timing diagrams illustrating operations in a method to implement an efficient luminous display in a 3D setting, according to embodiments.

DETAILED DESCRIPTION

Described herein are exemplary displays and systems and methods to implement an efficient luminous display which may be used in electronic devices. In the following description, numerous specific details are set forth to provide a thorough understanding of various embodiments. However, it will be understood by those skilled in the art that the various embodiments may be practiced without the specific details. In other instances, well-known methods, procedures, components, and circuits have not been illustrated or described in detail so as not to obscure the particular embodiments.

Figures 1A, 1B:
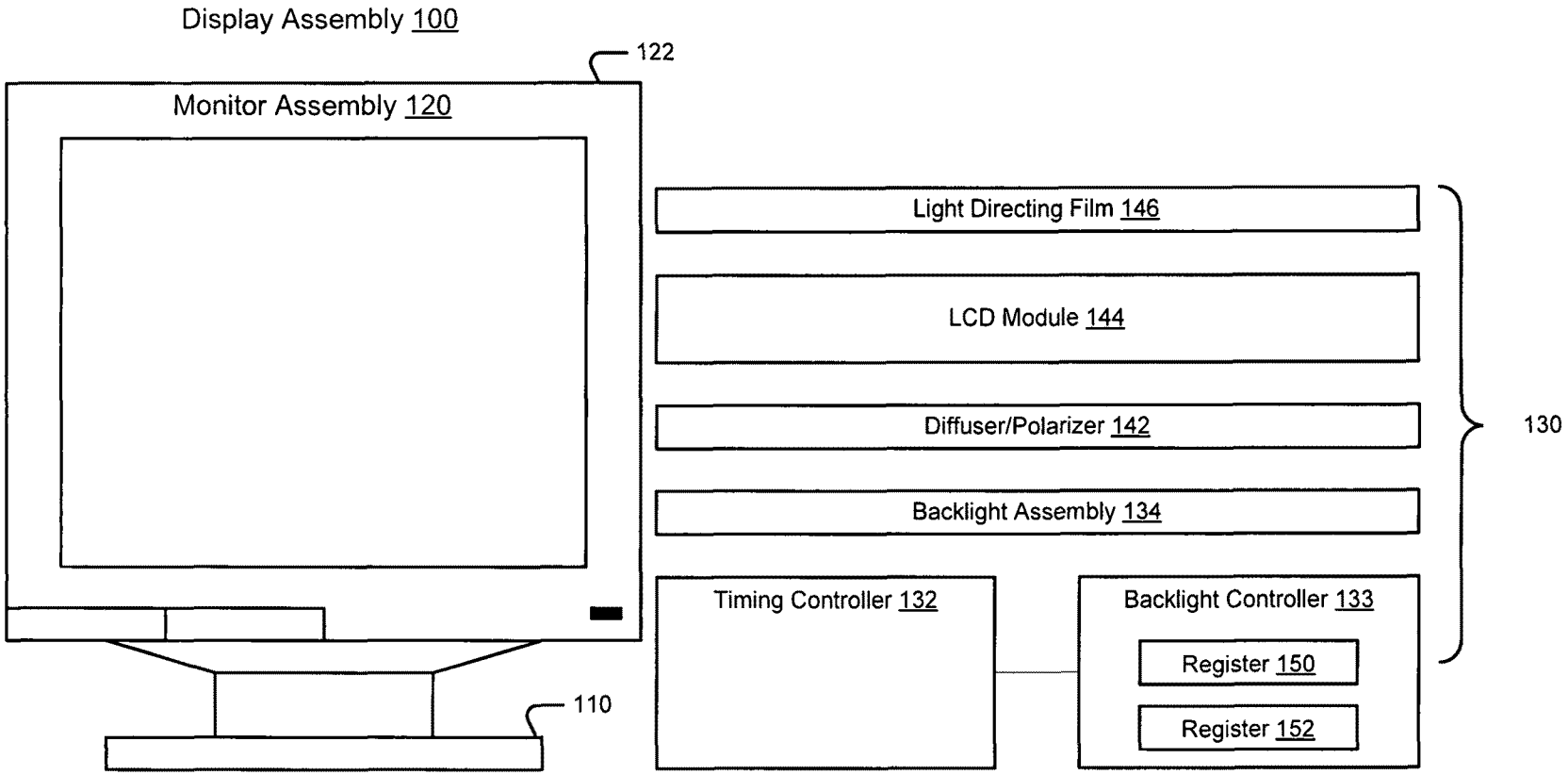
FIG. 1A is a schematic, front view of a display assembly, according to an embodiment.
FIG. 1B is an exploded, side view of a display assembly, according to an embodiment.
Figure 2:
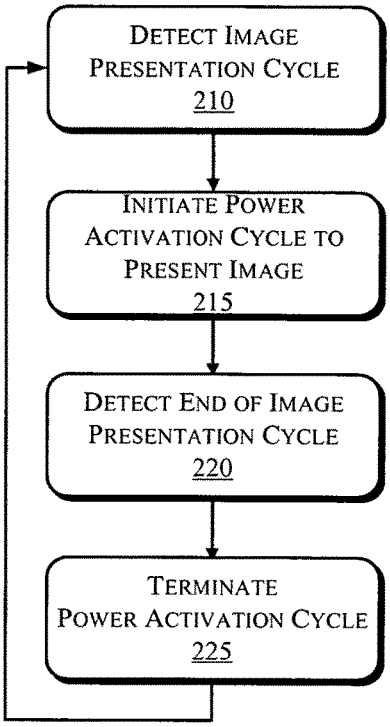
FIG. 2 is a flowchart illustrating operations in a method to implement an efficient luminous display, according to embodiments.

FIG. 1A is a schematic, front view of a LCD assembly, according to an embodiment, and FIG. 1B is an exploded, side view of a LCD assembly, according to an embodiment. Referring to FIG. 1A, a display assembly 100 comprises a base 110 and a monitor assembly 120 coupled to the base. Monitor assembly 120 comprises a housing 122, which houses a LCD assembly 130.

Referring to FIG. 1B, LCD assembly 130 comprises a timing controller 132, a backlight controller 133, a backlight assembly 134, a diffuser 142, a LCD module 144, and a light directing film 146. Display assembly 100 may be embodied as any type of color graphics display. In one embodiment, LCD module 144 may comprise a thin film transistor (TFT) assembly. In other embodiments, the LCD module 144 may embodied as a different type of luminous display, e.g OLED or Digital Mirrors display, a diode matrix or another capacitively driven LCD, a digital mirror assembly, or the like.

A diffuser 142 is positioned adjacent the backlight assembly 134. In some embodiments, diffuser 142 may also act as a polarizer to polarize light emitted by light-emitting diodes (LEDs) in the backlight assembly. A LCD module 144 is positioned adjacent diffuser 142. In some embodiments, LCD module may be a twisted nematic LCD, an In-plane switching LCD, or a vertical alignment (VA) LCD and may comprise other components for the display image formation such as tft backplane, polarizer, analyzer, color filter array, etc. In some embodiments, a light directing film 146 may be positioned adjacent the LCD to enhance the brightness of the display.

In some embodiments, timing controller 132 controls the timing parameters of operations of the display assembly 100, while backlight controller 133 drives the backlight assembly 134 to produce a peak luminance which is inversely proportional to the duty cycle of the backlight assembly when adjusted for the maximum display luminosity. This may be accomplished by pulsing the backlight assembly 134 at proportionally larger currents and/or by increasing the number of LEDs in the backlight assembly 134. Further, in some embodiments the timing controller 132 may adjust various timing parameters, for example the timing duration of the VBlank period.

In some embodiments techniques to implement an efficient luminous display may be implemented in a conventional LCD display to reduce power consumption while reducing motion blur on the display. This technique may be referred to as motion blur mitigation (MBM). Aspects of motion blur mitigation will be described with reference to FIG. 2 and FIGS. 3A-3C.

Figure 3A:
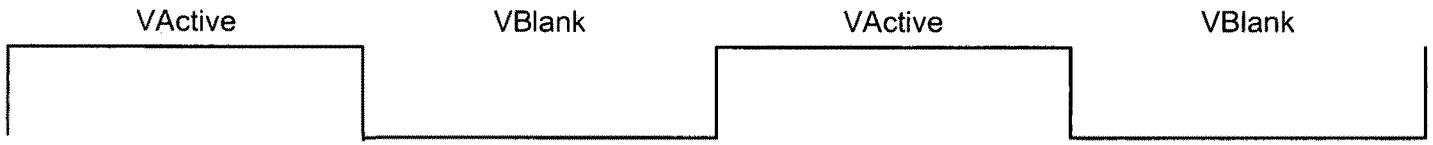
FIG. 3A is a timing diagram and FIGS. 3B-3C are power diagrams illustrating operations in a method to implement an efficient luminous display, according to embodiments.

FIG. 3A is a schematic illustration of a timing diagram for an LCD display such as the display assembly 100 depicted in FIG. 1. In operation, the LCD display cycles between a first period in which the image on the screen is updated, and a second period, in which the image is presented on the screen. By convention, the first period is commonly referred to as a $V_{Active}$ period, while the second period is commonly referred to as a $V_{Blank}$ period. As illustrated in FIG. 3A, in operation an LCD monitor cycles between $V_{Active}$ period and a $V_{Blank}$ period as the image on the screen is constantly updated. The monitor cycles at a rate such that the changes in the screen image appear smooth to the human eye, typically at a rate between 60 Hz and 240 Hz.

Figure 3B:
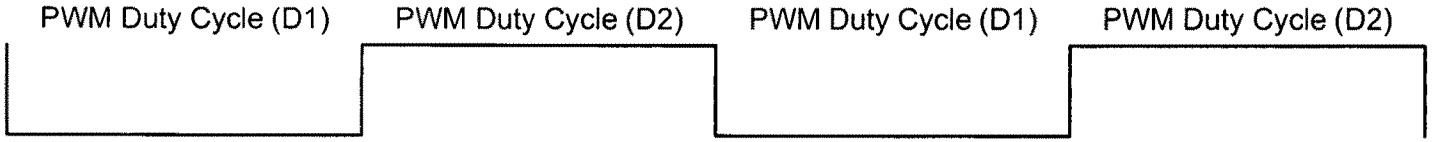

In some embodiments an LCD monitor may implement motion blur mitigation procedures which enhance the efficiency of the display. Referring to FIG. 3B, in one embodiment the timing controller 132 and the backlight controller 133 cooperate to enable the backlight controller to be activated only during the $V_{Blank}$ period. Thus, as illustrated in FIG. 3B the pulse wave modulation (PWM) duty cycle of the backlight assembly is an inverted profile of the timing diagram depicted in FIG. 3A. In some embodiments the timing controller 132 is communicatively coupled to the backlight controller 133 such that operations of the backlight controller may be coordinate with operations of the timing controller 132. The backlight controller 133 detects the initiation of an image presentation cycle, i.e., a $V_{Blank}$ period, (operation 210), initiates a power activation cycle (operation 215) at the beginning of the $V_{Blank}$ period, detects the end of an image presentation cycle, i.e., a $V_{Blank}$ period, (operation 220) and terminates the power activation cycle at the end of the $V_{Blank}$ period (operation 225).

In some embodiments the backlight controller may drive the backlight assembly at relatively high power levels, assuming there is no control of the peak current that can be driven to the light emitting diodes (LEDs) in the backlight assembly. The maximum panel brightness that can be obtained is therefore proportional to the $V_{Blank}$ period over the frame period relative to the peak brightness.

Referring back to FIG. 1, in some embodiments the backlight controller 133 comprises two registers 150, 152 that are used to control the backlight assembly 134. A first register 150 defines the duty cycle of the backlight during $V_{Active}$ period. A second register 152 defines the duty cycle during the $V_{Blank}$ period. In some embodiments the backlight controller implements logic which calculates appropriate values for these registers. The PWM frequency of the backlight assembly 134 is relatively high in relation to the frame rate to provide accurate control. Further, the PWM is generated such that each frame will generate identical waveforms when the controls remain constant in order to reduce flicker due to variations in intensity.

In some embodiments the register values are calculated as follows. A value T1 corresponds to the VActive period as a value between 0 and 1. Similarly, a value T2 corresponds to VBlank period as a value between 0 and 1. Neither T1 nor T2 may be zero. The sum of T1+T2 must equal 1, i.e., T1 and T2 represent a percent of the frame time. A value D1 corresponds to backlight PWM duty cycle during VActive as a value between 0 and 1, and a value D2 corresponds to a backlight PWM duty cycle during Vblank as a value between 0 and 1. Given these parameters, the total percent brightness of the display may be determined by:

$$T1*D1+T2*D2=\text{Total percent brightness} \quad \text{Eq. 1}$$

The maximum motion blur mitigation occurs when D1=0 and D2=1 therefore register calculations must satisfy $$T1*D1+T2*D2=T2 \quad \text{Eq. 2}$$

Figure 3C:
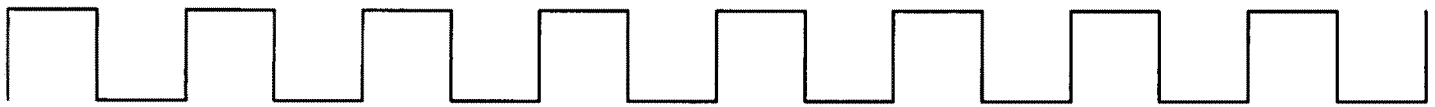

The minimum motion blur mitigation occurs when D1=D2=T2 therefore 0<D1<T2 (See FIG. 3C). Thus, given a PWM duty cycle for D1, the value for D2 may be calculated by:

$$D2=1-(T1*D1)/T2 \quad \text{Eq. 3}$$

For a virtual motion blur mitigation control (MBM) that varies from 0 (off) to 1, the value D1 may be determined by:

$$D1=(1-MBM)*T2 \quad \text{Eq. 4}$$

The resulting values for D1 and D2 may be scaled to register value requirements. By way of example, in a system in which the VBlank period is 40% of the time, T1=0.6 and T2=0.4, and in which motion blur mitigation (MBM2) is off (i.e., MBM2=0):

$$D1=(1-MBM2)*T2$$

$$D1=(1-0)*0.4$$

$$D1=0.4$$

$$D2=1-(T1*D1)/T2$$

$$D2=1-(0.6*0.4)/0.4$$

$$D2=0.4$$

By contrast, in a system in which the VBlank period is 40% of the time, T1=0.6 and T2=0.4, and in which motion blur mitigation (MBM) is fully on (i.e., MBM=1):

$$D1=(1-MBM)*T2$$

$$D1=(1-1)*0.4$$

$$D1=0$$

$$D2=1-(T1*D1)/T2$$

$$D2=1-(0.6*0)/0.4$$

$$D2=1$$

In a system in which the VBlank period is 40% of the time, T1=0.6 and T2=0.4, and in which motion blur mitigation (MBM) is set to 50% (i.e., MBM=0.5):

$$D1=(1-MBM)*T2$$

$$D1=(1-0.5)*0.4$$

$$D1=0.2$$

$$D2=1-(T1*D1)/T2$$

$$D2=1-(0.6*0.2)/0.4$$

$$D2=0.7$$

One skilled in the art will recognize that using PWM to control the brightness is not necessarily the only way. The D1 and D2 registers represent a proportional brightness. A general brightness control which is also possible through the D1 and D2 registers as a multiplicative factor. The virtual MBM control can be used to balance the MBM effect against the potential for perceived flicker in the display. At a refresh rate of 60 Hz, some people may notice flicker. For faster refresh rates this is not a problem.

In other embodiments techniques to implement an efficient luminous display may find application in display devices configured to present stereoscopic, three-dimensional (3D) images. General operations of such embodiments will be described with reference to FIGS. 4A and 4B and FIG. 5. FIGS. 4A and 4B are timing diagrams illustrating operations in a method to implement an efficient luminous display in a three-dimensional (3D) setting, according to embodiments.

FIG. 4A is a timing diagram of in a conventional display. Referring to FIG. 4A, in general a 3D display operates by successively presenting a right-eye image and a left-eye image on the screen. A view wears an eyeset which includes a right-eye shutter and a left-eye shutter. The timing of the shutters is coordinated with the timing on the display such that the right-eye shutter is open when the right-eye view is presented on the display and the left-eye shutter is open when the left-eye view is presented on the display. At a refresh rate of 60 Hz a typical frame duration is 16.67 milliseconds. Alternating between a right-eye view and a left-eye view in rapid succession essentially tricks a viewers brain into seeing a stereoscopic, 3D image. The salient features to note in FIG. 4A are that the backlight remains lit while the data lines are progressively updated and while the shutter is closed. Thus, significant amounts of light and power are wasted.

Figure 5:
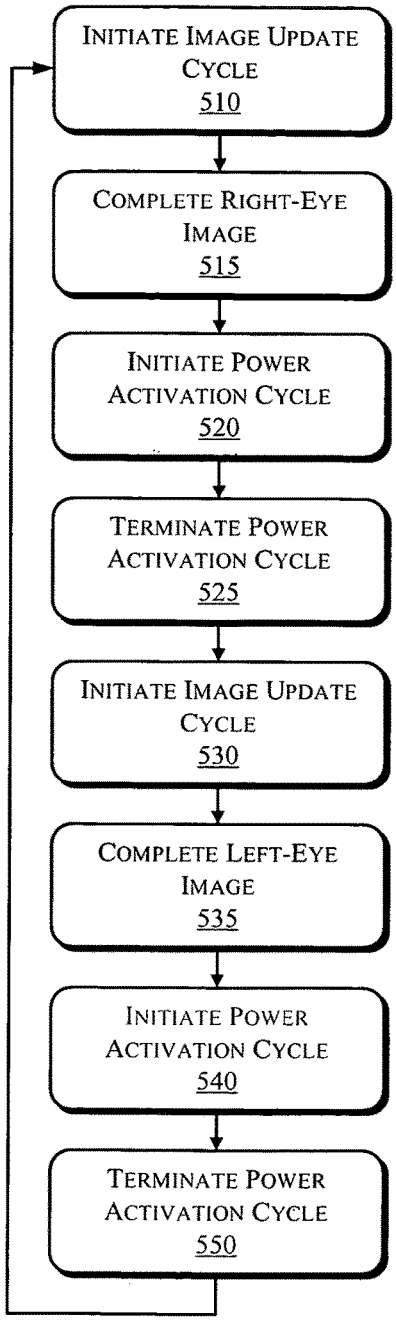
FIG. 5 is a flowchart illustrating operations in a method to implement an efficient luminous display in a 3D setting, according to embodiments.

Referring now to FIG. 4B and FIG. 5, in some embodiments the operation of a 3D monitor may be modified by shutting off the backlight when the display is being updated, and activating the backlight only when a complete right-eye or left-eye image is presented on the display. Thus, at operation 510 an image update cycle is initiated. Referring to FIG. 5B, the first image update cycle illustrates updating the display from a left-eye image to a right-eye image. The image update progressively updates the image from data line 0 to data line 3 of the display. The backlight is powered off during the update process. When the update process has completed and a complete right-eye image is presented (operation 515) on the display a power activation cycle is initiated (operation 520) to illuminate the backlight. Contemporaneously, a shutter cycle may be initiated. At operation 525 the power activation cycle is terminated when the next image refresh cycle begins (operation 530).

At operation 535 the complete left-eye image is presented on the display, at which point another power activation cycle is initiated (operation 540) to illuminate the backlight assembly. Contemporaneously, a shutter cycle may be initiated. At operation 550 the power activation cycle is terminated when the next image refresh cycle begins (operation 550). The operations depicted in FIG. 5 may be repeated, such that the backlight assembly is activated only when a complete right-eye or left-eye image is presented on the display.

Figure 6:
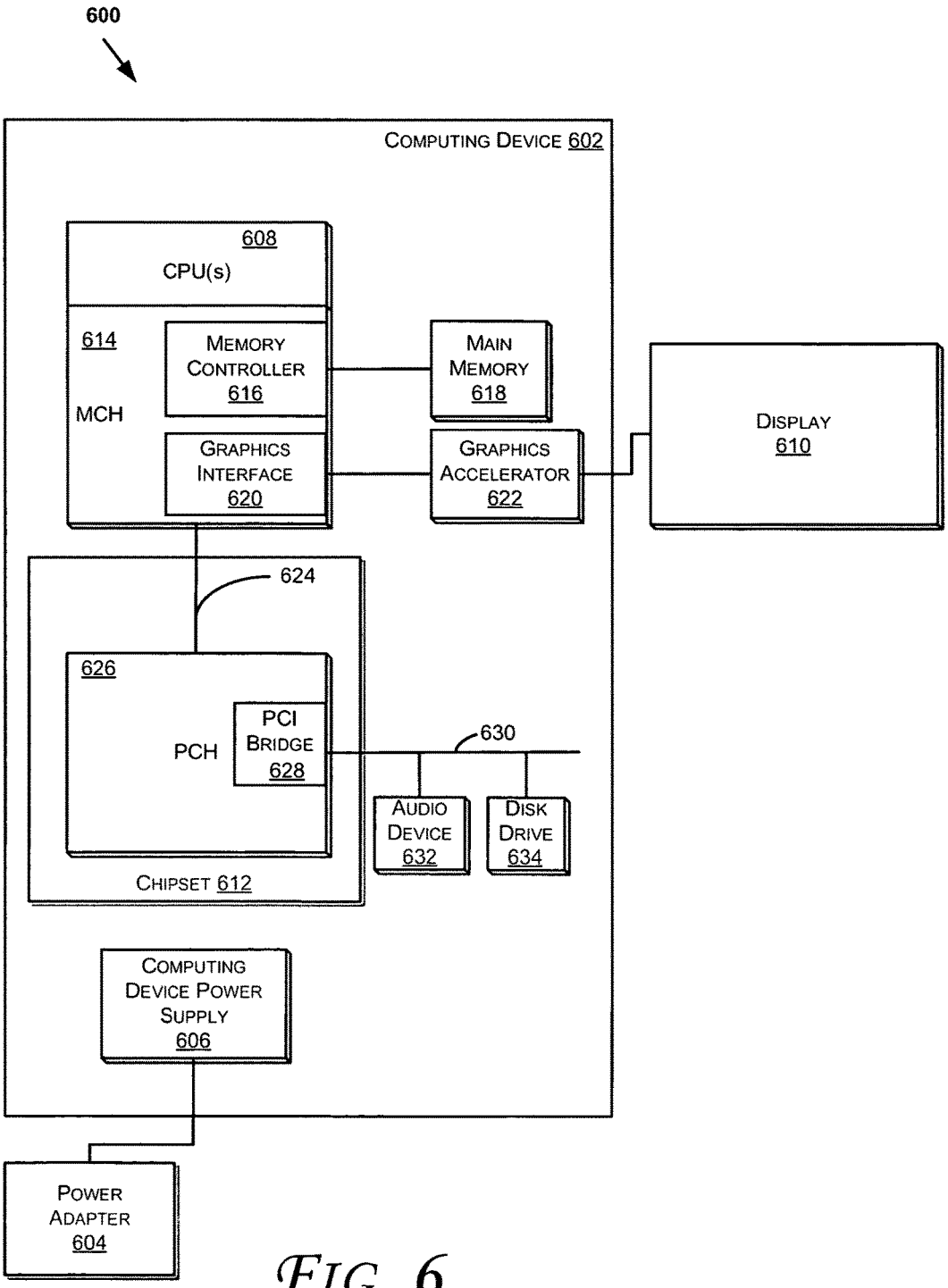
FIG. 6 is a schematic illustration of a system which may be adapted to implement data protection, according to an embodiment.

As described above, in some embodiments a display as described herein may be implemented in an electronic device, e.g., a computer system. FIG. 6 is a schematic illustration of a computer system 600 in accordance with some embodiments. The computer system 600 includes a computing device 602 and a power adapter 604 (e.g., to supply electrical power to the computing device 602). The computing device 602 may be any suitable computing device such as a laptop (or notebook) computer, a personal digital assistant, a desktop computing device (e.g., a workstation or a desktop computer), a rack-mounted computing device, and the like.

Electrical power may be provided to various components of the computing device 602 (e.g., through a computing device power supply 606) from one or more of the following sources: one or more battery packs, an alternating current (AC) outlet (e.g., through a transformer and/or adaptor such as a power adapter 604), automotive power supplies, airplane power supplies, and the like. In some embodiments, the power adapter 604 may transform the power supply source output (e.g., the AC outlet voltage of about 110 VAC to 240 VAC) to a direct current (DC) voltage ranging between about 7 VDC to 12.6 VDC. Accordingly, the power adapter 604 may be an AC/DC adapter.

The computing device 602 may also include one or more central processing unit(s) (CPUs) 608. In some embodiments, the CPU 608 may be one or more processors in the Pentium® family of processors including the Pentium® II processor family, Pentium® III processors, Pentium® IV, or CORE2 Duo processors available from Intel® Corporation of Santa Clara, Calif. Alternatively, other CPUs may be used, such as Intel's Itanium®, XEON™, and Celeron® processors. Also, one or more processors from other manufactures may be utilized. Moreover, the processors may have a single or multi core design.

A chipset 612 may be coupled to, or integrated with, CPU 608. The chipset 612 may include a memory control hub (MCH) 614. The MCH 614 may include a memory controller 616 that is coupled to a main system memory 618. The main system memory 618 stores data and sequences of instructions that are executed by the CPU 608, or any other device included in the system 600. In some embodiments, the main system memory 618 includes random access memory (RAM); however, the main system memory 618 may be implemented using other memory types such as dynamic RAM (DRAM), synchronous DRAM (SDRAM), and the like. Additional devices may also be coupled to the bus 610, such as multiple CPUs and/or multiple system memories.

The MCH 614 may also include a graphics interface 620 coupled to a graphics accelerator 622. In some embodiments, the graphics interface 620 is coupled to the graphics accelerator 622 via an accelerated graphics port (AGP). In some embodiments, a display (such as a flat panel display) 640 may be coupled to the graphics interface 620 through, for example, a signal converter that translates a digital representation of an image stored in a storage device such as video memory or system memory into display signals that are interpreted and displayed by the display. The display 640 signals produced by the display device may pass through various control devices before being interpreted by and subsequently displayed on the display.

A hub interface 624 couples the MCH 614 to an platform control hub (PCH) 626. The PCH 626 provides an interface to input/output (I/O) devices coupled to the computer system 600. The PCH 626 may be coupled to a peripheral component interconnect (PCI) bus. Hence, the PCH 626 includes a PCI bridge 628 that provides an interface to a PCI bus 630. The PCI bridge 628 provides a data path between the CPU 608 and peripheral devices. Additionally, other types of I/O interconnect topologies may be utilized such as the PCI Express™ architecture, available through Intel® Corporation of Santa Clara, Calif.

The PCI bus 630 may be coupled to an audio device 632 and one or more disk drive(s) 634. Other devices may be coupled to the PCI bus 630. In addition, the CPU 608 and the MCH 614 may be combined to form a single chip. Furthermore, the graphics accelerator 622 may be included within the MCH 614 in other embodiments.

Additionally, other peripherals coupled to the PCH 626 may include, in various embodiments, integrated drive electronics (IDE) or small computer system interface (SCSI) hard drive(s), universal serial bus (USB) port(s), a keyboard, a mouse, parallel port(s), serial port(s), floppy disk drive(s), digital output support (e.g., digital video interface (DVI)), and the like. Hence, the computing device 602 may include volatile and/or nonvolatile memory.

The terms "logic instructions" as referred to herein relates to expressions which may be understood by one or more machines for performing one or more logical operations. For example, logic instructions may comprise instructions which are interpretable by a processor compiler for executing one or more operations on one or more data objects. However, this is merely an example of machine-readable instructions and embodiments are not limited in this respect.

The terms "computer readable medium" as referred to herein relates to media capable of maintaining expressions which are perceivable by one or more machines. For example, a computer readable medium may comprise one or more storage devices for storing computer readable instructions or data. Such storage devices may comprise storage media such as, for example, optical, magnetic or semiconductor storage media. However, this is merely an example of a computer readable medium and embodiments are not limited in this respect.

The term "logic" as referred to herein relates to structure for performing one or more logical operations. For example, logic may comprise circuitry which provides one or more output signals based upon one or more input signals. Such circuitry may comprise a finite state machine which receives a digital input and provides a digital output, or circuitry which provides one or more analog output signals in response to one or more analog input signals. Such circuitry may be provided in an application specific integrated circuit (ASIC) or field programmable gate array (FPGA). Also, logic may comprise machine-readable instructions stored in a memory in combination with processing circuitry to execute such machine-readable instructions. However, these are merely examples of structures which may provide logic and embodiments are not limited in this respect.

Some of the methods described herein may be embodied as logic instructions on a computer-readable medium. When executed on a processor, the logic instructions cause a processor to be programmed as a special-purpose machine that implements the described methods. The processor, when configured by the logic instructions to execute the methods described herein, constitutes structure for performing the described methods. Alternatively, the methods described herein may be reduced to logic on, e.g., a field programmable gate array (FPGA), an application specific integrated circuit (ASIC) or the like.

In the description and claims, the terms coupled and connected, along with their derivatives, may be used. In particular embodiments, connected may be used to indicate that two or more elements are in direct physical or electrical contact with each other. Coupled may mean that two or more elements are in direct physical or electrical contact. However, coupled may also mean that two or more elements may not be in direct contact with each other, but yet may still cooperate or interact with each other.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. A display assembly, comprising:

a liquid crystal module;

a backlight assembly comprising an illumination source;

a first register to store a first duty cycle (D1) of the backlight assembly during an image update cycle having a first duration in time (T1);

a second register to store a second duty cycle (D2) of the backlight assembly during an image presentation cycle having a second duration in time (T2);

a timing controller; and a backlight controller comprising logic to:

initiate a power activation cycle at the beginning of the image presentation timing cycle;

terminate the power activation cycle at the termination of the image presentation timing cycle;

determine the second duty cycle (D2) as a function of T1, T2, and D1.

2. The display assembly of claim 1, wherein the backlight controller is to drive the backlight assembly to a high voltage during the entire image presentation timing cycle.

3. The display assembly of claim 1, wherein the backlight controller to hold backlight assembly to a low voltage during the entire image update timing cycle.

4. The display assembly of claim 1, wherein the second duty cycle (D2) is determined using the equation:

$$D2=1-(T1*D1)/T2.$$

5. The display assembly of claim 1, wherein the timing controller to determine a duration of the image presentation timing cycle.

6. An apparatus, comprising:

a first register to store a first duty cycle (D1) of a backlight assembly during an image update cycle having a first duration in time (T1);

a second register to store a second duty cycle (D2) of the backlight assembly during an image presentation cycle having a second duration in time (T2); and a timing controller; and a backlight controller comprising logic to:

initiate a power activation cycle at the beginning of the image presentation timing cycle;

terminate the power activation cycle at the termination of the image presentation timing cycle;

determine the second duty cycle (D2) as a function of T1, T2, and D1.

7. The apparatus of claim 6, wherein the backlight controller drives the backlight assembly to a fully on state during the entire image presentation timing cycle.

8. The apparatus of claim 6, wherein the backlight controller holds backlight assembly to a low voltage during an entire image refresh timing cycle.

9. The apparatus of claim 6, wherein the second duty cycle (D2) is determined using the equation:

$$D2=1-(T1*D1)/T2.$$

10. The apparatus of claim 6, wherein the timing controller determines a duration of the image presentation timing cycle.

11. A display assembly, comprising:

a liquid crystal module;

a backlight assembly comprising an array of light emitting diodes; and a first register to store a first duty cycle (D1) of the backlight during an image update cycle having a first duration in time (T1);

a second register to store a second duty cycle (D2) of the backlight during an image presentation cycle having a second duration in time (T2);

a timing controller comprising logic to:

alternately present a right-eye image and a left-eye image; and a backlight controller coupled to the timing controller, wherein the backlight controller comprises logic to:

initiate a power activation cycle at the beginning of the image presentation timing cycle;

terminate the power activation cycle at the termination of the image presentation timing cycle;

determine a second duty cycle (D2) as a function of T1, T2, and D1.

12. The display assembly of claim 11, wherein the backlight controller to drive the backlight assembly to a high voltage during the entire power activation cycle.

13. The display assembly of claim 11, wherein the image refresh cycle progressively to write an image across lines of the display.

14. The display assembly of claim 13, wherein the backlight controller to hold backlight assembly to a low voltage during the entire image refresh timing cycle.

15. The display assembly of claim 11, wherein the second duty cycle (D2) is determined using the equation:

$$D2=1-(T1*D1)/T2.$$

* * * * *